US005653531A

United States Patent [19]

Yang

[11] Patent Number: 5,653,531

[45] Date of Patent: Aug. 5, 1997

[54] DESK LAMP

[76] Inventor: Kuo-Fu Yang, P.O. Box 82-144, Taipei, Taiwan

[21] Appl. No.: 594,799

[22] Filed: Jan. 31, 1996

[51] Int. Cl.[6] ..... F21V 9/06; F21S 1/12

[52] U.S. Cl. ..... 362/352; 362/396; 362/414

[58] Field of Search ..... 362/352, 356, 362/396, 410, 414, 432, 450, 806

[56] References Cited

U.S. PATENT DOCUMENTS 4,562,521 12/1985 Noguchi ..... 362/806

FOREIGN PATENT DOCUMENTS 669918 4/1952 United Kingdom ..... 362/352

*Primary Examiner*—Y My Quach

*Attorney, Agent, or Firm*—Alfred Lei

[57] ABSTRACT

A desk lamp including a tripod including a fixing plate and three supporting legs, an electrical socket fixedly mounted in a center hole of the fixing plate, a light bulb fitted in the electrical socket, and an inverted conical lampshade having a lower end fixedly engaged with the electrical socket, whereby the desk lamp can be easily assembled by the consumer.

1 Claim, 2 Drawing Sheets

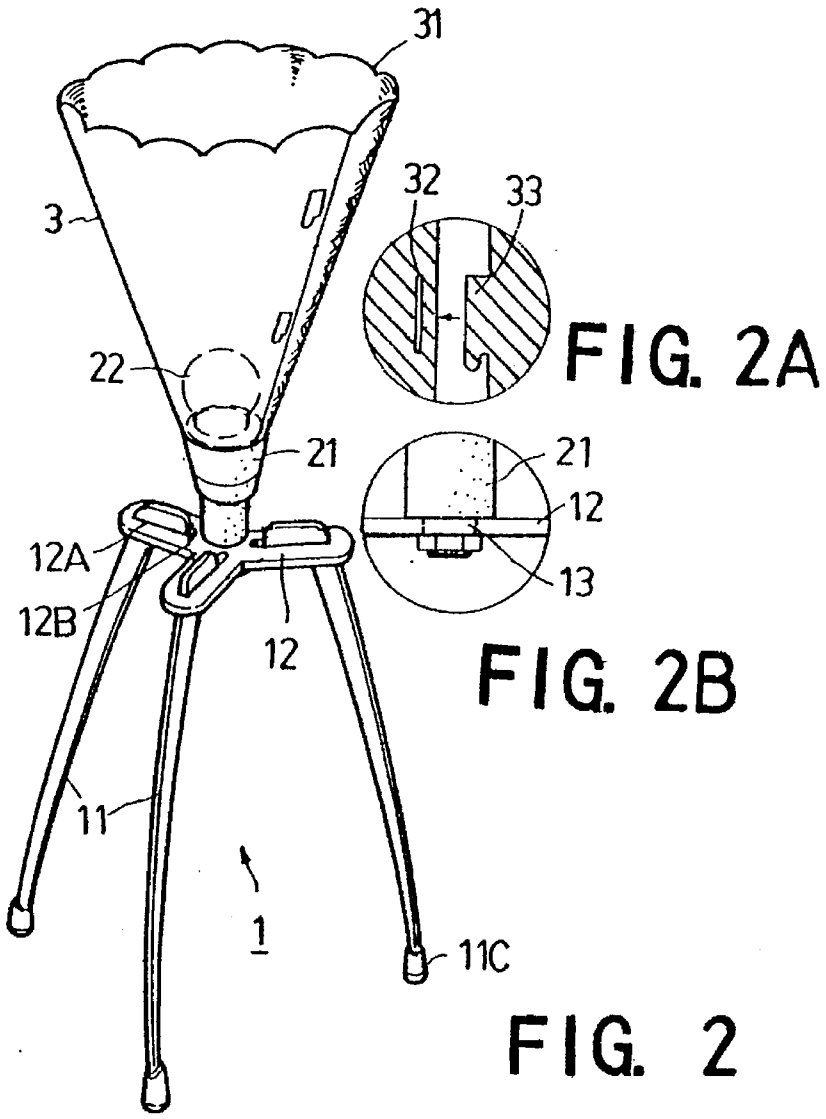
FIG. 2A
FIG. 2B
FIG. 2
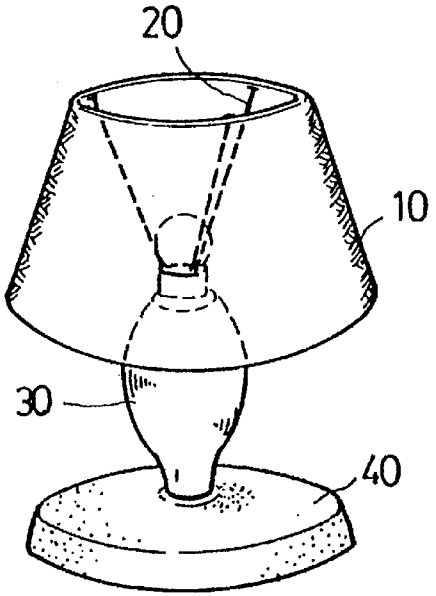
PRIOR ART
FIG. 1

DESK LAMP

BACKGROUND OF THE INVENTION

1. Field of the Invention

This invention relates to an improved desk lamp.

2. Description of the Prior Art

It has been found that the conventional desk lamp sold on the market has already been assembled thereby making it hardly possible to reduce the retail price. Therefore, it is an object of the present invention to provide a desk lamp which can obviate and mitigate the above-mentioned drawbacks.

SUMMARY OF THE INVENTION

This invention relates to an improved desk lamp.

It is the primary object of the present invention to provide a desk lamp which can be easily assembled by the consumer.

It is another object of the present invention to provide a desk lamp which is compact in size.

It is still another object of the present invention to provide a desk lamp which can be placed at the market at a very low cost.

It is still another object of the present invention to provide a desk lamp which is simple in construction.

It is a further object of the present invention to provide a desk lamp which is facile to manufacture.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which Will be indicated in the claims following.

BRIEF DESCRIPTION OF THE DRAWINGS

FIG. 1 is a perspective view of a prior art desk lamp;

FIG. 2 is a perspective view of a desk lamp according to the present invention;

FIG. 2A is an enlarged fragmentary view of the present invention;

FIG. 2B is another enlarged fragmentary view of the present invention;

DETAILED DESCRIPTION OF THE PREFERRED EMBODIMENT

Figure 4:
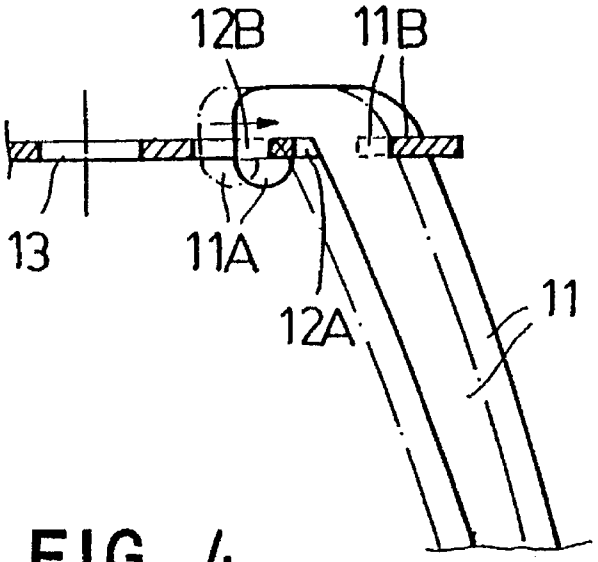
FIG. 4 is a sectional view illustrating how the tripod is locked in the fixing plate.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

With reference to the drawings and in particular to FIGS. 2, 2A and 2B thereof, the desk lamp according to the present invention mainly comprises a tripod 1, an electrical socket 21 and a lampshade 3.

Figure 3:
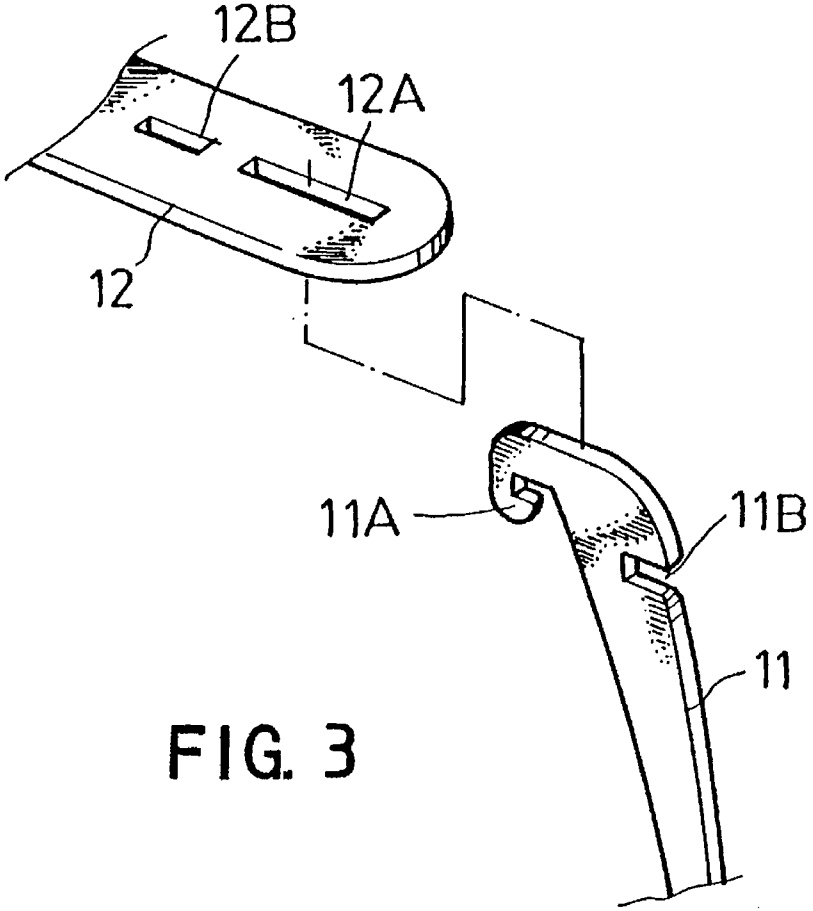
FIG. 3 illustrates the structure of engaging the supporting leg with the fixing plate.

As shown, the tripod 1 includes a fixing plate 12 and three supporting legs 11. The fixing plate 12 is a triangular member formed with a center hole 13 and three radial leaves each having a large slot 12A close to the tip and a small slot 12B behind the large slot 12A. The supporting leg 11 is formed with a hook portion 11A and a notch 11B at the upper end. Each supporting leg 11 is inserted through the large slot 12A of the fixing plate 12 with its hook portion 11A fitted through the small slot 12B of the fixing plate 12 and then pushed to the right (with respect to FIGS. 3 and 4) so that the hook portion 11A and the notch 11B of the supporting leg 11 are snugly fitted with the right edge of the small slot 12B and the large slot 12A respectively.

The electrical socket 21 is fixedly mounted in the center hole 13 of the fixing plate 12. A light bulb 22 is fitted in the electrical socket 21. The electrical socket 21 may be of any conventional design and is not considered a part of the invention.

The lampshade 3 is an inverted conical member having its lower end fixedly engaged with the socket 21. The connection between the lampshade 3 and the socket 21 is well known in the art and need not be described here in detail. The lampshade 3 is made of a sectorial plastic sheet which is formed with a plurality of convex projections 31 at the upper edge, a plurality of slits 32 at a lateral edge, and a plurality of protuberances 33 at the other lateral edge engaged with respective slits 32. However, it should be noted that the lampshade 3 may be generally cylindrical in shape or shaped as a frustum (not shown).

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A desk lamp comprising:

a tripod including a fixing plate and three supporting legs, said fixing plate being a triangular member formed with a center hole and three radial leaves, each of said leaves having a first slot and a second slot behind the first slot, each of said supporting legs being formed with a hook portion and a notch at an upper end thereof with a lower end supporting on a surface, each of said supporting legs being inserted through said first slot with said hook portion fitted through said second slot and then pushed away from the center hole of said fixing plate so that said hock portion and said notch are snugly fitted with an edge of said second and first slots respectively;

an electrical socket fixedly mounted in said center hole of said fixing plate;

a light bulb fitted in said electrical socket; and a lampshade having a lower end fixedly engaged with said electrical socket, said lampshade being made of a sectorial plastic sheet formed with a plurality of convex projections at an upper edge thereof, a plurality of slits at one lateral edge thereof, and a plurality of protuberances engaged with respective slits.

* * * * *